US008042235B2

(12) United States Patent
Wu

(10) Patent No.: US 8,042,235 B2
(45) Date of Patent: Oct. 25, 2011

(54) BUCKLING DEVICE FOR SAFETY BELT

(75) Inventor: Wen-Yuan Wu, Hemei Township, Changhua County (TW)

(73) Assignee: Taiwan Racing Products Co., Ltd., Changhua County (TW)

( * ) Notice: Subject to any disclaimer, the term of this patent is extended or adjusted under 35 U.S.C. 154(b) by 303 days.

(21) Appl. No.: 12/471,577

(22) Filed: May 26, 2009

(65) Prior Publication Data

US 2010/0299885 A1 Dec. 2, 2010

(51) Int. Cl.
*A44B 11/25* (2006.01)

(52) U.S. Cl. ..... 24/323; 24/185; 24/179; 24/636; 24/641

(58) Field of Classification Search ..... 24/323, 24/170, 179, 180, 191, 193, 192, 185, 182, 24/633, 636, 645, 646, 343, 641
See application file for complete search history.

(56) References Cited

U.S. PATENT DOCUMENTS

| | | | | |
|---|---|---|---|---|
| 4,091,508 | A * | 5/1978 | Yamada et al. | 24/171 |
| 4,642,858 | A * | 2/1987 | Ishiguro et al. | 24/641 |
| 6,216,323 | B1 * | 4/2001 | Oyamada | 24/641 |
| 7,350,277 | B1 * | 4/2008 | Canfield et al. | 24/634 |
| 2007/0114255 | A1 * | 5/2007 | Spadaccini | 224/257 |

* cited by examiner

*Primary Examiner* — Robert Sandy
*Assistant Examiner* — Rowland D Do
(74) *Attorney, Agent, or Firm* — Alan Kamrath; Kamrath & Associates PA

(57) ABSTRACT

A buckling device for safety belts includes a buckle made of metal material and bent to form a projected holder. A wider segment of the holder is used to insert a side of the safety belt to the buckle. On each of two sides of a narrower segment of the holder is mounted a second side plate. Between two second side plates is defined a locking unit by using a shank. On an upper rim of the second side plate is a recess. The locking unit includes an engagement member in which a rotary member, a fixing piece, a compression spring, a mounting member, and a torsion spring are received. A fastening member includes a bottom sheet, with a wider segment thereof being used to insert another side of the safety belt. The fastening member further includes a retaining pore secured on a narrower segment thereof.

20 Claims, 9 Drawing Sheets

BUCKLING DEVICE FOR SAFETY BELT

BACKGROUND OF THE INVENTION

1. Field of the Invention

The present invention relates to a buckling device and, more particularly, to a buckling device for a safety belt that can be used safely.

2. Description of the Prior Art

Conventional safety belts are used in general vehicles and racing cars. However, they have the following disadvantages:

1. In buckling operation, the engagement member of the buckling device has to be rotated to a certain angle to insert the fastening member into the buckle, making operating inconvenient.

2. The conventional buckling devices are buckled in a one-section operating manner to disengage the engagement member easily, causing unsafety in car crashes.

3. The holder of the conventional buckles is forged, resulting in a heavy weight.

The present invention has arisen to mitigate and/or obviate the afore-described disadvantages.

SUMMARY OF THE INVENTION

The primary object of the present invention is to provide a buckling device for safety belts that in buckling operation, the engagement member of the locking unit can be at any position without being rotated to a certain angle to directly engage the narrower segment of the fastening member with the buckle. The engagement member pushes the mounting member of the locking unit, so that the knob of the mounting member is retained in the retaining pore of the fastening member by using a torsion spring, making buckling the buckle easy.

A further object of the present invention is to provide a buckling device for safety belts that in buckling operation, the mounting member of the locking unit retains the knob in the retaining pore of the fastening member by a torsion spring, and the two ends of the fixing piece of the locking unit engage the recesses of the second side plates of the locking unit to achieve a two-section buckling operation, providing a preferred safety.

Another object of the present invention is to provide a buckling device for safety belts that the holder of the buckle is formed of a metal plate, lowering its weight.

A buckling device for safety belts in accordance with a preferred embodiment of the present invention includes a buckle made of metal material and bent to form a projected holder. A wider segment of the holder is used to insert a side of the safety belt to the buckle. On each of two sides of a narrower segment of the holder is mounted a second side plate. Between two second side plates is defined a locking unit by using a shank. On an upper rim of the second side plate is fixed a recess. The locking unit includes an engagement member in which a rotary member, a fixing piece, a compression spring, a mounting member, and a torsion spring are received. Two ends of the fixing piece extend out of two sides of the engagement member. The compression spring abuts against the fixing piece and the engagement member, and the torsion spring is biased against the mounting member. A fastening member includes a bottom sheet, with a wider segment thereof being used to insert another side of the safety belt. The fastening member further includes a retaining pore secured on a narrower segment thereof.

DETAILED DESCRIPTION OF THE PREFERRED EMBODIMENTS

The present invention will be clearer from the following description when viewed together with the accompanying drawings, which show, for purpose of illustration only, the preferred embodiment in accordance with the present invention.

Figure 1:
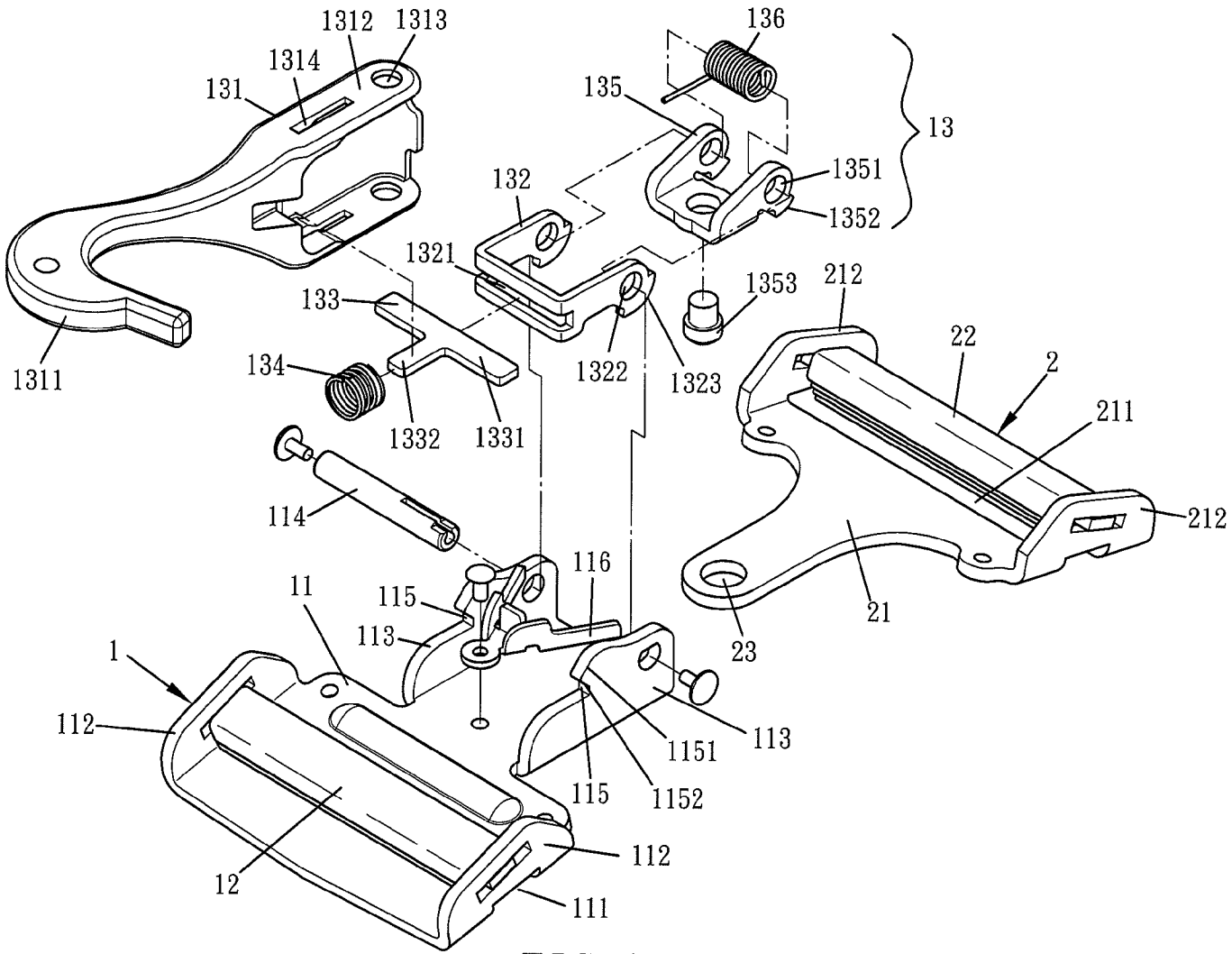
FIG. 1 is a perspective view showing the exploded components of a buckling device for safety belts according to a preferred of the present invention.
Figure 2:
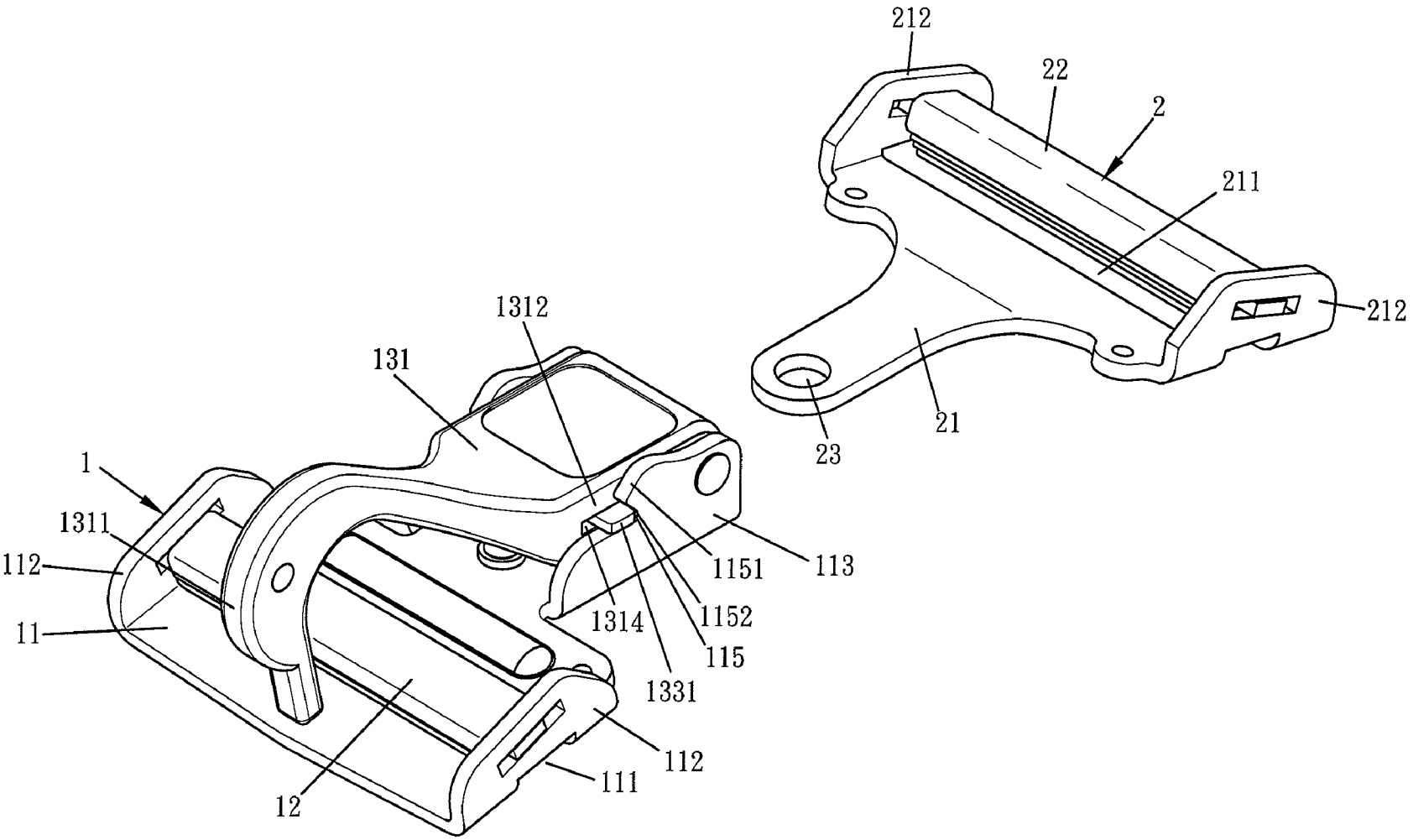
FIG. 2 is a perspective view showing the assembly of the buckling device for safety belts according to the preferred embodiment of the present invention.
Figure 3:
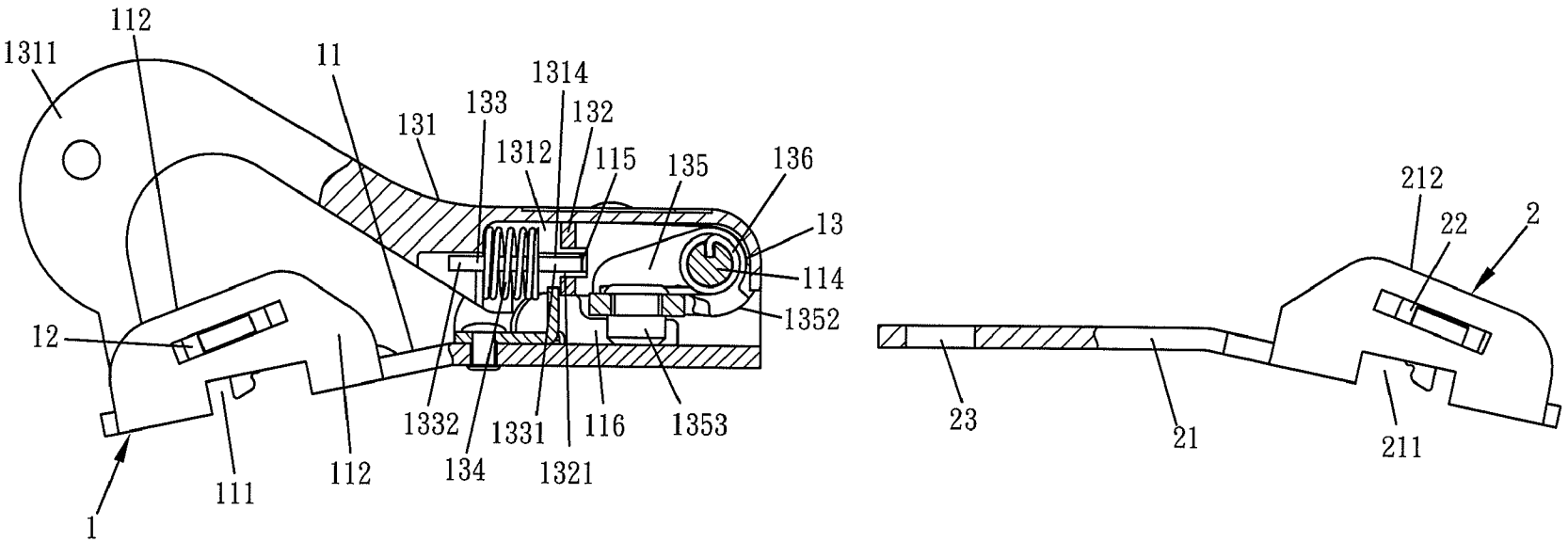
FIG. 3 is a cross section view showing the assembly of the buckling device for safety belts according to the preferred embodiment of the present invention.
Figure 4:
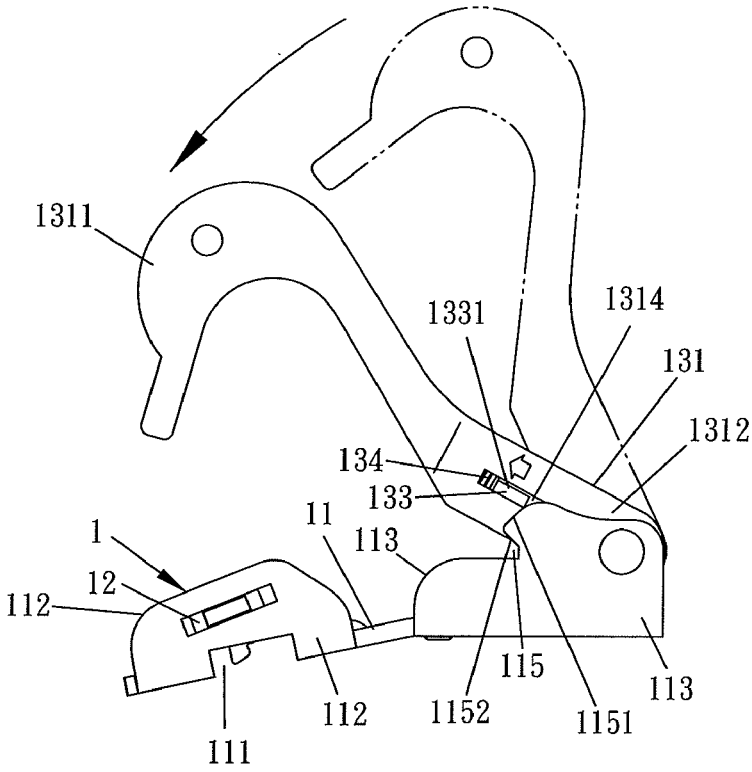
FIG. 4 is a side plan view showing the buckling operation of an engagement member of the buckling device for safety belts according to the preferred embodiment of the present invention.
Figure 5:
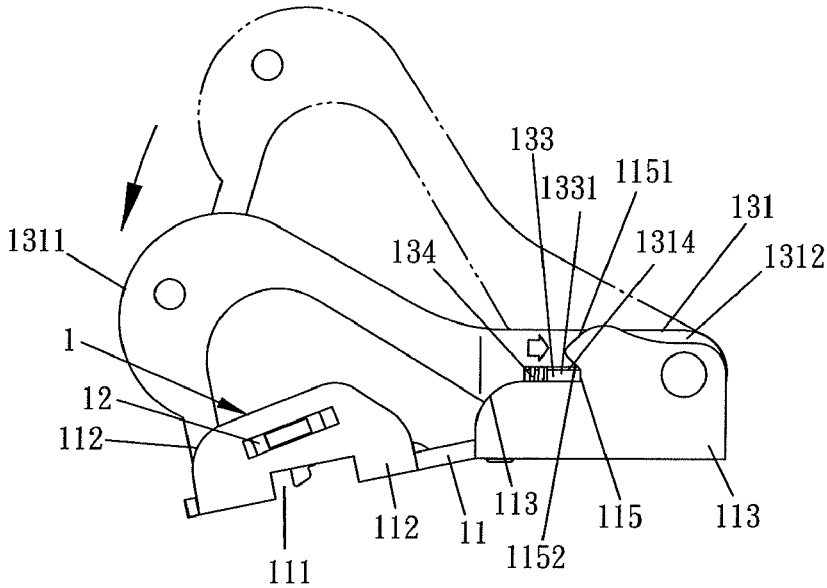
FIG. 5 is a side plan view showing the buckling operation of the engagement member of the buckling device for safety belts according to the preferred embodiment of the present invention.
Figure 6:
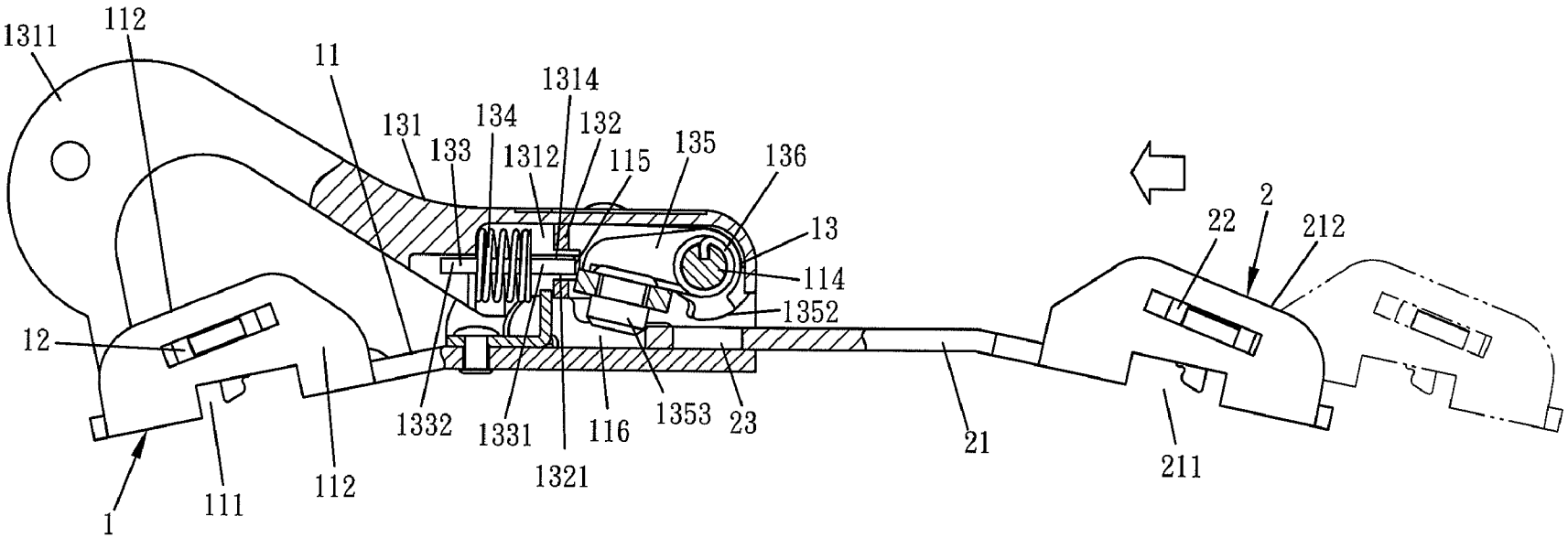
FIG. 6 is a cross sectional view showing the buckling operation of the buckling device for safety belts according to the preferred embodiment of the present invention.
Figure 7:
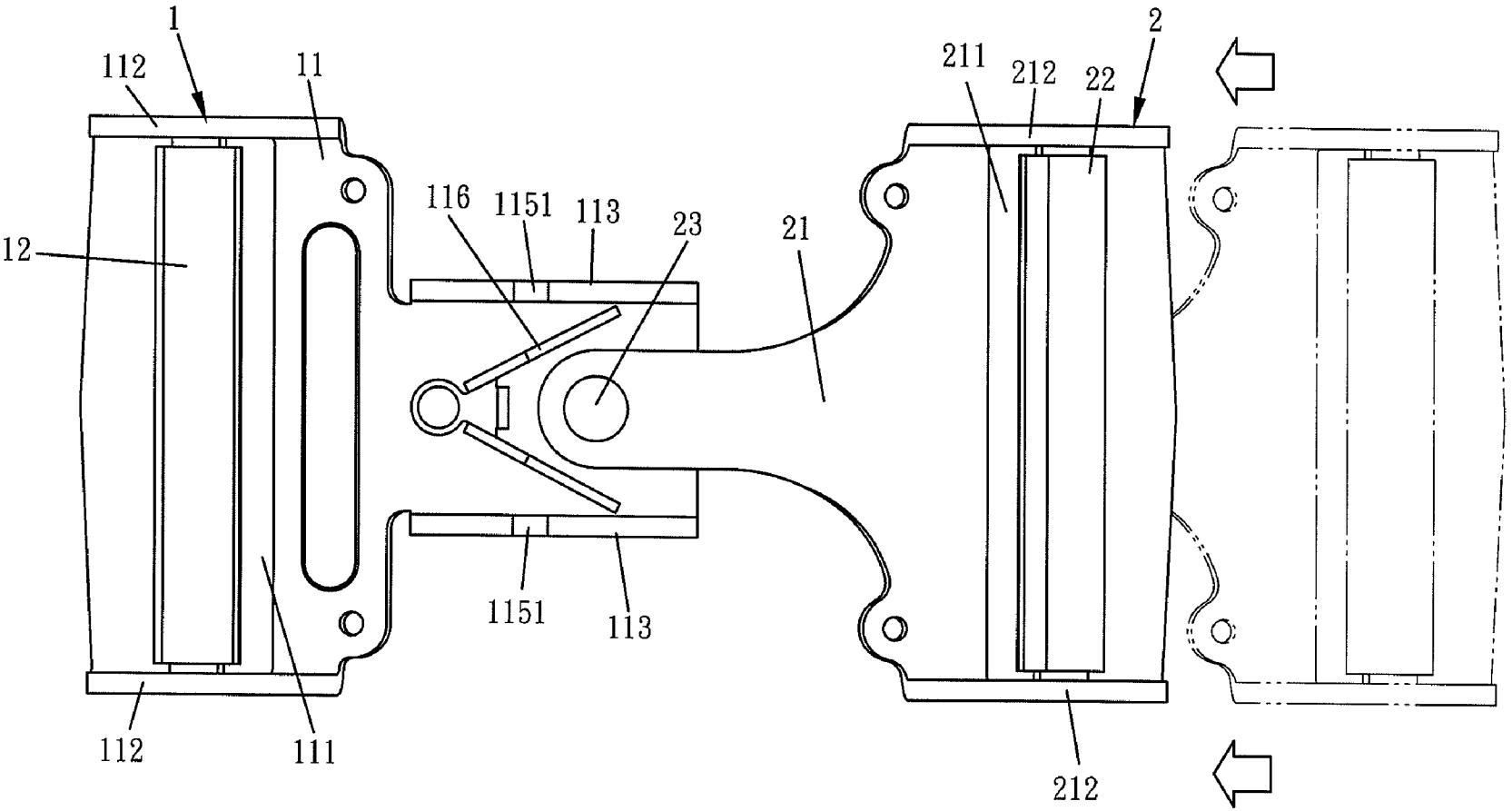
FIG. 7 is a top plan view showing the buckling operation of the buckling device for safety belts according to the preferred embodiment of the present invention.
Figure 8:
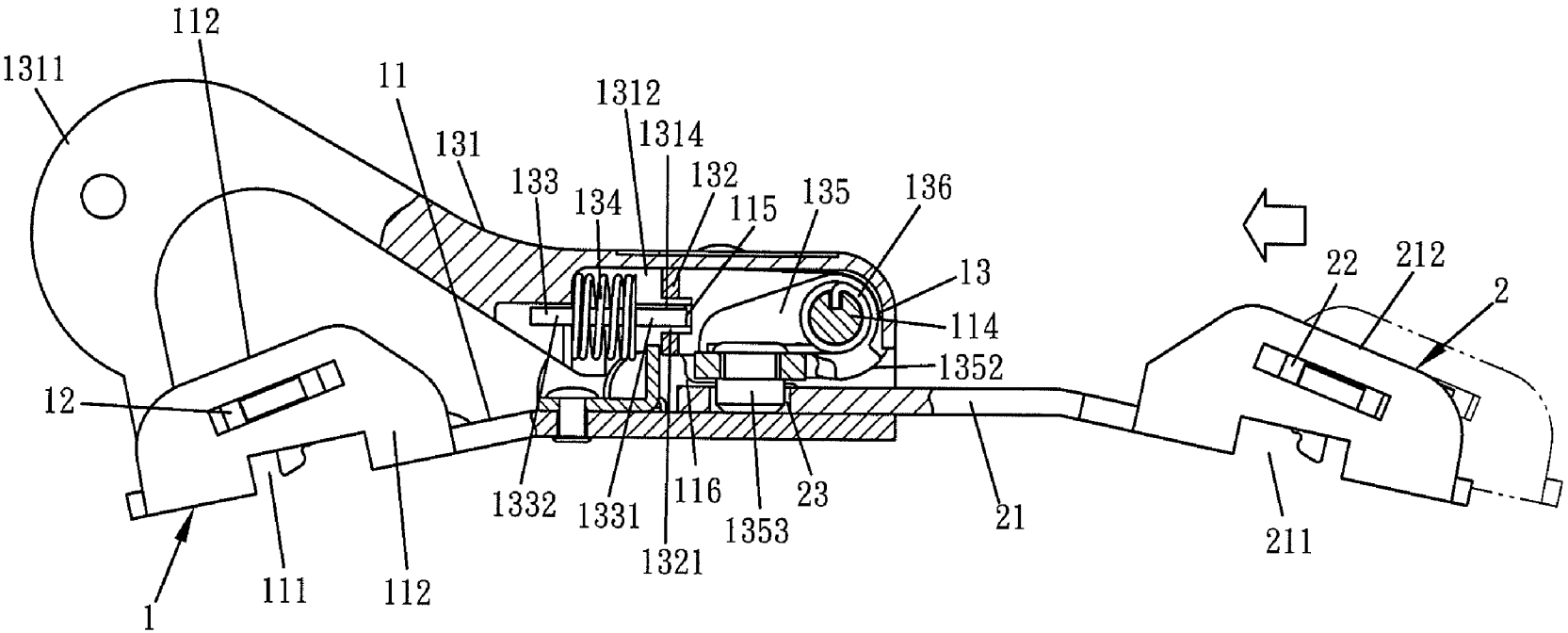
FIG. 8 is another cross sectional view showing the buckling operation of the buckling device for safety belts according to the preferred embodiment of the present invention.

Referring to FIGS. 1-3, a buckling device for safety belts in accordance with a preferred embodiment of the present invention includes a buckle 1, and a fastening member 2. The buckle 1 is made of metal material and bent to form a projected holder 11. A wider segment of the holder 11 includes a laterally elongated hole 111 and two sides thereof are respectively bent to form a first side plates 112. Between two first side plates 112 is defined a sideable shaft 12, such that a side of the safety belt can be inserted to the buckle 1. On each of two sides of a narrower segment of the holder 11 is mounted a second side plate 113. Between two second side plates 113 is defined a locking unit 13 by using a shank 114. On an upper rim of the second side plate 113 is a recess 115 on which two inclined planes 1151, 1152 are arranged. The narrower segment of the holder 11 further includes a V-shaped guiding member 116 riveted thereon, and the locking unit 13 includes an engagement member 131. On one end of the engagement member 131 is disposed a hook 1311, and on another end is mounted a seat 1312. The seat 1312 includes a rotary member 132 and a fixing piece 133 received therein. Two ends of the fixing piece 133 extend out of two outer sides of the engagement member 131 respectively. The seat 1312 further includes a compression spring 134 secured between the fixing piece 133 and the seat 1312. A mounting member 135 is received in the rotary member 132, with a torsion spring 136 pushing against the mounting member 135. On two sides of the seat 1312 of the engagement member 131 are respectively formed an opening 1313 for inserting the shank 114 and a bore 1314 for inserting the fixing piece 133. The rotary member 132 is formed in an inverted C shape and includes an elongated gap 1321 disposed on a middle segment thereof. Two through apertures 1322 are arranged on two ends of the rotary member 132 for inserting the shank 114, and an abutting tab 1323 for engaging with the seat 1312 of the engagement member 131 is fixed on each of outer rims of the two ends of the rotary member 132. The fixing piece 133 includes a stem 1331 and a post 1332 extending from a middle section of the stem 1331. The stem 1331 is inserted into the elongated gap 1321 of the rotary member 132 so as to position the rotary member 132. The compression spring 134 is fitted to the post 1332 of the fixing piece 133. The mounting member 135 is formed in an inverted C shape and includes an orifice 1351 arranged on each end of two side walls thereof for inserting the shank 114 and includes an actuating projection 1352 disposed on a lower side of each end of the two side walls thereof to bias against the seat 1312 of the engagement member 131. The mounting member 135 also includes a post-shaped knob 1353 riveted on a central portion of a bottom thereof. Besides, the torsion spring 136 is fitted onto the shank 114. One foot of the torsion spring 136 is biased against the mounting member 135, and another foot thereof is inserted into a cutout formed on the shank 114, so that as the mounting member 135 is pushed by the torsion spring 136, the knob 1353 engages with the narrower segment of the holder 11 of the buckle 1.

The fastening member 2 includes a bottom sheet 21 having a lateral slit 211 mounted on a wider segment thereof. The fastening member 2 has a third side plate 212 extending from each of two sides of the fastening member 2, and between the two third side plates 212 is fixed a slidable rod 22, such that the slit 211 receives another side of the safety belt therein by matching with the rod 22. The fastening member 2 also includes a retaining pore 23 secured on a narrower segment thereof, and the buckle 1 or the fastening member 2 can include a soft pad (not shown) riveted thereon.

In buckling operation, as shown in FIGS. 4-8, the engagement member 131 of the locking unit 13 is rotated toward the holder 11 of the buckle 1 so that the two ends of the stem 1331 of the fixing piece 133 of the locking unit 13 are retained in the recesses 115 of the second side plates 113 of the holder 11 by using the compression spring 134 along the inclined planes 1151. One part of the stem 1331 is inserted into the elongated gap 1321 of the rotary member 132 to position the rotary member 132, and the narrower segment of the fastening member 2 engages with the buckle 1 so that the narrower segment of the fastening member 2 is guided by the guiding member 116 to push the knob 1353. Hence, the knob 1353 is actuated to rotate the mounting member 135 along the shank 114 and to rotate the torsion spring 136. After the narrower segment of the fastening member 2 is inserted into position, the mounting member 135 returns to its initial position by using the torsion spring 136, and the knob 1353 engages in the retaining pore 23 of the fastening member 2 securely, obtaining a two-section engagement. Also, the narrower segment of the fastening member 2 is inserted to engage with the buckle 1 so that the narrower segment of the fastening member 2 pushes the knob 1353 to actuate the mounting member 135 to axially rotate along the shank 114 and to actuate the torsion spring 136. After the narrower segment of the fastening member 2 is inserted into position, the mounting member 135 returns to its original position by using the torsion spring 136, and the knob 1353 is retained in the retaining pore 23 of the fastening member 2. Thereafter, the engagement member 131 of the locking unit 13 rotates toward the holder 11 of the buckle 1 so that the two ends of the stem 1331 of the fixing piece 133 of the locking unit 13 matches with the compression spring 134 and are retained in the recesses 115 of the second side plates 113 of the holder 11 along the inclined planes 1151. One part of the stem 1331 is inserted in the elongated gap 1321 of the rotary member 132 to position the rotary member 132, obtaining a two-section engagement.

Figure 9:
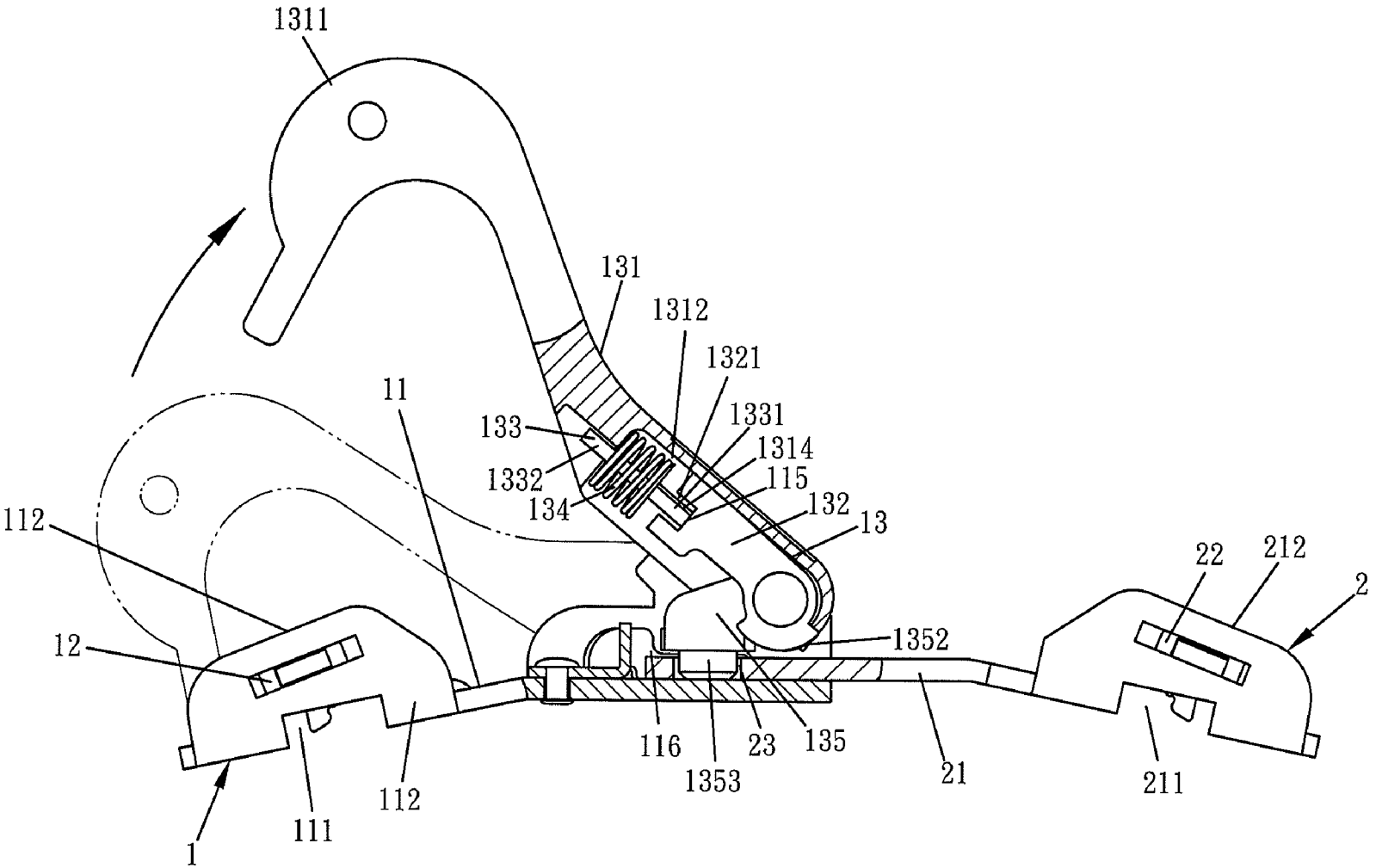
FIG. 9 is a cross sectional view showing the unbuckling operation of the buckling device for safety belts according to the preferred embodiment of the present invention.
Figure 10:
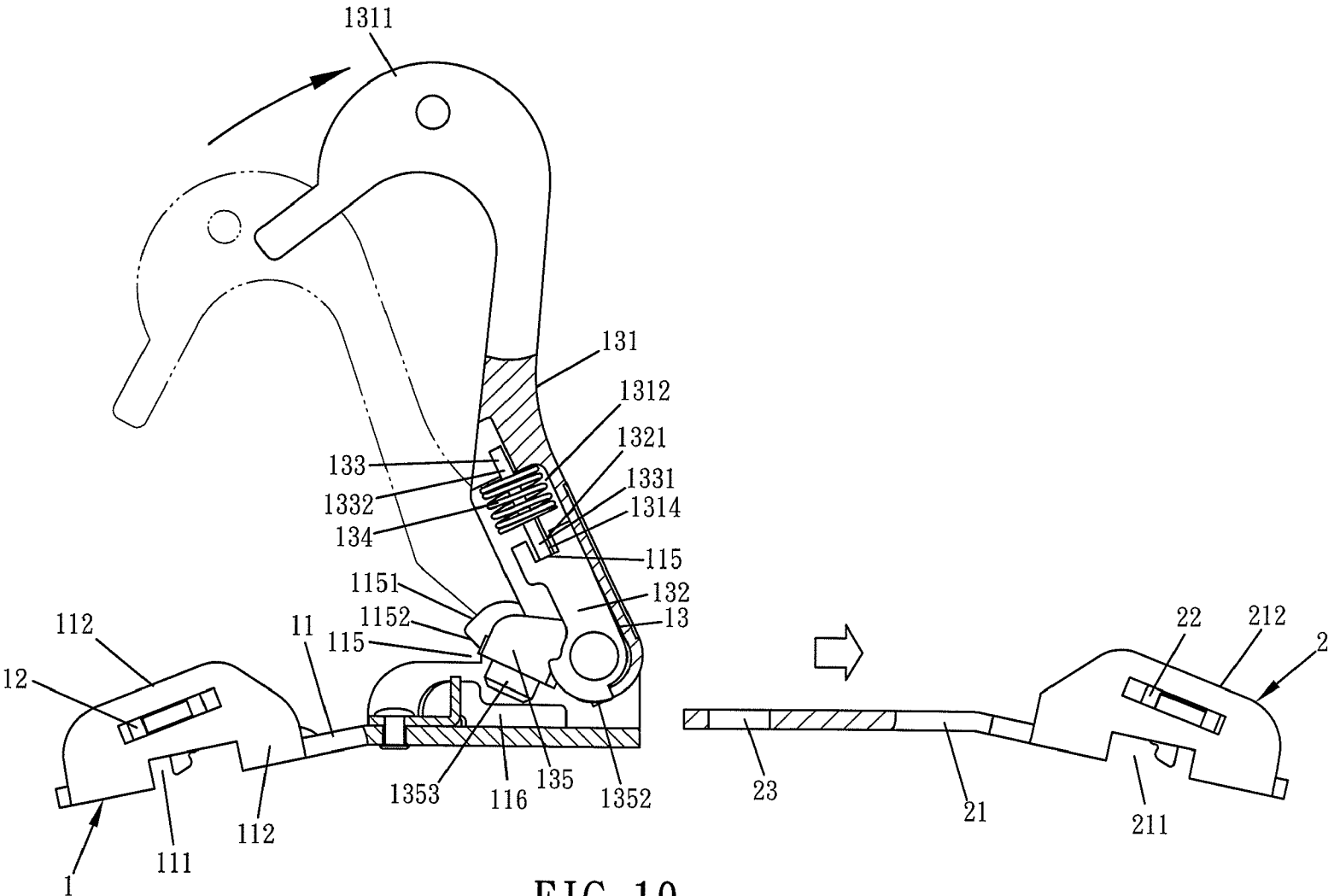
FIG. 10 is another cross sectional view showing the unbuckling operation of the buckling device for safety belts according to the preferred embodiment of the present invention.

When unbuckling the safety belt, as illustrated in FIGS. 9 and 10, the engagement member 131 of the locking unit 13 is rotated adversely so that the stem 1331 of the fixing piece 133 of the locking unit 13 cooperates with the compression spring 134 to disengage from the recesses 115 of the second side plates 113 of the locking unit 13 along the inclined planes 1152. In the meantime, the mounting member 135 is still retained in the retaining pore 23 of the fastening member 2 by the torsion spring 136. Then, the engagement member 131 is further rotated so that the actuating projection 1352 actuates the mounting member 135 to axially rotate. Hence, the knob 1353 of the mounting member 135 disengages from the retaining pore 23 of the fastening member 2, removing the fastening member 2 from the buckle 1.

It is apparent from the above description that the present invention has the following advantages:

1. In buckling operation, the engagement member 131 of the locking unit 13 can be at any position without being rotated to a certain angle to directly engage the narrower segment of the fastening member 2 with the buckle 1. Then, the engagement member 131 pushes the mounting member 135 of the locking unit 13 so that the knob 1353 of the mounting member 135 is retained in the retaining pore 23 of the fastening member 2 by using the torsion spring 136, making buckling the buckle easy.

2. In buckling operation, the mounting member 135 of the locking unit 13 retains the knob 1353 in the retaining pore 23 of the fastening member 2 by the torsion spring 136, and the two ends of the fixing piece 133 of the locking unit 13 engage the recesses 115 of the second side plates 113 of the locking unit 13 to achieve a two-section buckling operation, having a preferred safety.

3. The holder 11 of the buckle 1 is formed of a metal plate, lowering its weight.

While various embodiments in accordance with the present invention have been shown and described, it is clear to those skilled in the art that further embodiments may be made without departing from the scope of the present invention.

What is claimed is:

1. A buckling device for safety belts comprising:

a buckle made of metal material and bent to form a projected holder, with a wider segment of the projected holder being used to insert a side of the safety belt to the buckle, wherein on each of two sides of a narrower segment of the projected holder is mounted a second side plate, wherein between two second side plates is defined a locking unit by using a shank, wherein on an upper rim of each second sideplate is a recess, with the locking unit including an engagement member in which a rotary member, a fixing piece, a compression spring, a mounting member, and a torsion spring are received, with two ends of the fixing piece extending out of two sides of the engagement member, with the compression spring abutting against the fixing piece and the engagement member, and with the torsion spring biasing against the mounting member;

a fastening member including a bottom sheet, with a wider segment of the bottom sheet being used to insert another side of the safety belt, with the fastening member including a retaining pore secured on a narrower segment of the bottom sheet, wherein on one end of the engagement member is disposed a hook and on another end is mounted a seat, and wherein on two sides of the seat are respectively formed an opening for inserting the shank and a bore for inserting the fixing piece.

2. The buckling device for safety belts as claimed in claim 1, wherein on the recess are arranged two inclined planes.

3. The buckling device for safety belts as claimed in claim 1, wherein the narrower segment of the holder further includes a V-shaped guiding member riveted thereon.

4. The buckling device for safety belts as claimed in claim 1, wherein the fixing piece of the locking unit includes a post extending from a middle section of a stem to fit the compression spring.

5. The buckling device for safety belts as claimed in claim 1, wherein the mounting member of the locking unit also includes a post-shaped knob riveted on a central portion of a bottom thereof.

6. The buckling device for safety belts as claimed in claim 1, wherein the buckle includes a soft pad riveted thereon.

7. The buckling device for safety belts as claimed in claim 1, wherein the fastening member includes a soft pad riveted thereon.

8. A buckling device for safety belts comprising:

a buckle made of metal material and bent to form a projected holder, with a wider segment of the projected holder being used to insert a side of the safety belt to the buckle, wherein on each of two sides of a narrower segment of the projected holder is mounted a second side plate, wherein between two second side plates is defined a locking unit by using a shank wherein on an upper rim of each second side plate is a recess, with the locking unit including an engagement member in which a rotary member, a fixing piece, a compression spring, a mounting member, and a torsion spring are received, with two ends of the fixing piece extending out of two sides of the engagement member, with the compression spring abutting against the fixing piece and the engagement member, and with the torsion spring biasing against the mounting member;

a fastening member including a bottom sheet, with a wider segment of the bottom sheet being used to insert another side of the safety belt, with the fastening member including a retaining pore secured on a narrower segment of the bottom sheet, wherein the rotary member is formed in an inverted C shape and includes an elongated gap disposed on a middle segment thereof to insert the fixing piece, wherein two through apertures for inserting the shank are arranged on two ends of the rotary member, and wherein an abutting tab for engaging with the engagement member is fixed on each outer rim of the two ends of the rotary member.

9. The buckling device for safety belts as claimed in claim 8, wherein on the recess are arranged two inclined planes.

10. The buckling device for safety belts as claimed in claim 8, wherein the narrower segment of the holder further includes a V-shaped guiding member riveted thereon.

11. The buckling device for safety belts as claimed in claim 8, wherein the fixing piece of the locking unit includes a post extending from a middle section of a stem to fit the compression spring.

12. The buckling device for safety belts as claimed in claim 8, wherein the mounting member of the locking unit also includes a post-shaped knob riveted on a central portion of a bottom thereof.

13. A buckling device for safety belts comprising:

a buckle made of metal material and bent to form a projected holder, with a wider segment of the projected holder being used to insert a side of the safety belt to the buckle, wherein on each of two sides of a narrower segment of the projected holder is mounted a second side plate, wherein between two second side plates is defined a locking unit by using a shank, wherein on an upper rim of each second side plate is a recess, with the locking unit including an engagement member in which a rotary member, a fixing piece, a compression spring, a mounting member, and a torsion spring are received, with two ends of the fixing piece extending out of two sides of the engagement member, with the compression spring abutting against the fixing piece and the engagement member, and with the torsion spring biasing against the mounting member;

a fastening member including a bottom sheet, with a wider segment of the bottom sheet being used to insert another side of the safety belt, with the fastening member including a retaining pore secured on a narrower segment of the bottom sheet, wherein the mounting member of the locking unit is formed in an inverted C shape and includes an orifice arranged on each end of two side walls thereof for inserting the shank, and wherein the mounting member includes an actuating projection disposed on a lower side of each end of the two side walls thereof to bias against the seat of the engagement member.

14. The buckling device for safety belts as claimed in claim 13, wherein on the recess are arranged two inclined planes.

15. The buckling device for safety belts as claimed in claim 13, wherein the narrower segment of the holder further includes a V-shaped guiding member riveted thereon.

16. The buckling device for safety belts as claimed in claim 13, wherein the fixing piece of the locking unit includes a post extending from a middle section of a stem to fit the compression spring.

17. The buckling device for safety belts as claimed in claim 13, wherein the mounting member of the locking unit also includes a post-shaped knob riveted on a central portion of a bottom thereof.

18. A buckling device for safety belts comprising:

a buckle made of metal material and bent to form a projected holder, with a wider segment of the projected holder being used to insert a side of the safety belt to the buckle, wherein on each of two sides of a narrower segment of the projected holder is mounted a second side plate, wherein between two second side plates is defined a locking unit by using a shank, wherein on an upper rim of each second side plate is a recess, with the locking unit including an engagement member in which a rotary member, a fixing piece, a compression spring, a mounting member, and a torsion spring are received, with two ends of the fixing piece extending out of two sides of the engagement member, with the compression spring abutting against the fixing piece and the engagement member, and with the torsion spring biasing against the mounting member;

a fastening member including a bottom sheet, with a wider segment of the bottom sheet being used to insert another side of the safety belt, with the fastening member including a retaining pore secured on a narrower segment of the bottom sheet, wherein the mounting member of the locking unit also includes a post-shaped knob riveted on a central portion of a bottom thereof, wherein the torsion spring is fitted onto the shank, wherein one foot of the torsion spring is biased against the mounting member and another foot of the torsion spring is inserted into a cutout formed on the shank so that as the mounting member is pushed by the torsion spring, the post-shaped knob engages with the narrower segment of the projected holder of the buckle.

19. The buckling device for safety belts as claimed in claim 18, wherein on the recess are arranged two inclined planes.

20. The buckling device for safety belts as claimed in claim 18, wherein the narrower segment of the holder further includes a V-shaped guiding member riveted thereon.

* * * * *